US008709206B2

(12) United States Patent
Xia et al.

(10) Patent No.: US 8,709,206 B2
(45) Date of Patent: Apr. 29, 2014

(54) PAPERBOARD CONTAINING RECYCLED FIBERS AND METHOD OF MAKING THE SAME

(71) Applicant: Sonoco Development Inc., Hartsville, SC (US)

(72) Inventors: Zheming Xia, Florence, SC (US); James Fogg, Ballston Spa, NY (US); Mark Velicer, De Pere, WI (US); Matthew Meister, De Pere, WI (US)

(73) Assignee: Sonoco Development Inc., Hartsville, SC (US)

( * ) Notice: Subject to any disclaimer, the term of this patent is extended or adjusted under 35 U.S.C. 154(b) by 0 days.

(21) Appl. No.: 13/792,511

(22) Filed: Mar. 11, 2013

(65) Prior Publication Data

US 2013/0186583 A1 Jul. 25, 2013

Related U.S. Application Data

(62) Division of application No. 12/883,506, filed on Sep. 16, 2010, now Pat. No. 8,419,899.

(60) Provisional application No. 61/244,597, filed on Sep. 22, 2009, provisional application No. 61/247,720, filed on Oct. 1, 2009, provisional application No. 61/253,184, filed on Oct. 20, 2009, provisional application No. 61/348,443, filed on May 26, 2010.

(51) Int. Cl.
*D21H 11/00* (2006.01)

(52) U.S. Cl.
USPC ..... 162/161

(58) Field of Classification Search
USPC ..... 162/161, 100, 231, 4, 6, 8; 424/443
See application file for complete search history.

(56) References Cited

U.S. PATENT DOCUMENTS

| | | | |
|---|---|---|---|
| 4,275,719 | A | 6/1981 | Mayer |
| 4,626,354 | A | 12/1986 | Hoffman et al. |
| 5,338,401 | A | 8/1994 | Naddeo et al. |
| 5,368,749 | A | 11/1994 | LaZonby |
| 5,505,774 | A | 4/1996 | Manning |
| 5,560,805 | A | 10/1996 | Hamilton et al. |
| 5,624,575 | A | 4/1997 | Meade et al. |
| 5,631,300 | A | 5/1997 | Wellinghoff |
| 5,830,320 | A | 11/1998 | Park et al. |
| 5,900,111 | A | 5/1999 | Nystrom et al. |
| 5,965,617 | A | 10/1999 | Pohlman et al. |
| 5,980,758 | A | 11/1999 | LaZonby et al. |
| 6,228,126 | B1 | 5/2001 | Cimeciouglu et al. |
| 6,267,897 | B1 | 7/2001 | Robertson et al. |
| 6,290,091 | B1 | 9/2001 | Bell |
| 6,322,667 | B1 | 11/2001 | McCall et al. |
| 6,361,963 | B1 | 3/2002 | Smith et al. |
| 6,391,150 | B1 | 5/2002 | Berger et al. |
| 6,419,837 | B1 | 7/2002 | Akse |
| 6,472,223 | B1 | 10/2002 | Stannard et al. |
| 6,478,973 | B1 | 11/2002 | Barak |
| 6,569,286 | B1 | 5/2003 | Withenshaw et al. |
| 6,824,648 | B2 | 11/2004 | Edwards et al. |
| 6,833,055 | B2 | 12/2004 | Hansen et al. |
| 6,969,443 | B1 | 11/2005 | Kokko |
| 7,008,545 | B2 | 3/2006 | Cronan, Jr. et al. |
| 7,052,614 | B2 | 5/2006 | Barak |
| 7,067,063 | B2 | 6/2006 | Barak |
| 7,189,329 | B2 | 3/2007 | Barak |
| 7,285,224 | B2 | 10/2007 | Barak |
| 7,311,878 | B2 | 12/2007 | Singleton et al. |
| 7,314,570 | B2 | 1/2008 | Zikeli et al. |
| 7,449,120 | B2 | 11/2008 | Barak |
| 7,481,937 | B2 | 1/2009 | Rice et al. |
| 7,628,929 | B2 | 12/2009 | Barak |
| 7,651,622 | B2 | 1/2010 | Barak |
| 2002/0108730 | A1 | 8/2002 | Cronan, Jr. et al. |
| 2002/0125196 | A1 | 9/2002 | Rosenblatt et al. |
| 2003/0044314 | A1 | 3/2003 | Aamodt et al. |
| 2003/0121868 | A1 | 7/2003 | Barak |
| 2003/0132173 | A1 | 7/2003 | Barak |
| 2003/0220036 | A1 | 11/2003 | Lee et al. |
| 2004/0035803 | A1 | 2/2004 | Cronan, Jr. et al. |
| 2004/0103985 | A1 | 6/2004 | Morin et al. |
| 2004/0118852 | A1 | 6/2004 | Barmore et al. |
| 2005/0155731 | A1 | 7/2005 | Martin et al. |

(Continued)

FOREIGN PATENT DOCUMENTS

| | | | |
|---|---|---|---|
| EP | 2 130 434 | A2 | 12/2009 |
| WO | WO 2006/117382 | A1 | 11/2006 |
| WO | WO 2008/065629 | A1 | 6/2008 |
| WO | WO 2009/067514 | A1 | 5/2009 |

OTHER PUBLICATIONS

Development of Microbiological Guidelines for Food Grade Paperboard: A Historical Perspective, Oscar W. May, Tappi Journal, vol. 77, No. 12, pp. 41-43 (Dec. 1994).

Sustainable Packaging and Printing Solutions, Meadwestvaco website printout, Sep. 1, 2010 (first printed in Jun. 2010).

MWare for cold beverage cups, Meadwestvaco website printout, Jun. 2010.

Busan 1215 microbiocide label.

Starbucks Coffee Company website printout, Sep. 1, 2010.

*Primary Examiner* — Mark Halpern

(74) *Attorney, Agent, or Firm* — Womble Carlyle Sandridge & Rice, LLP

(57) ABSTRACT

A method of making a paper-based product includes substantially continuously treating a papermaking furnish including from greater than 0% to 100% recycled fibers with a biocide, and forming the furnish into the paper-based product. The furnish has a microorganism level of greater than 5,000 colony forming units per gram, and substantially continuously treating the furnish with the biocide reduces the microorganism level so that the paper-based product has a microorganism level of less than 5,000 colony forming units per gram.

78 Claims, 2 Drawing Sheets

(56) References Cited

U.S. PATENT DOCUMENTS

| | | | |
|---|---|---|---|
| 2005/0194324 | A1 | 9/2005 | Barak |
| 2006/0003023 | A1 | 1/2006 | Williams |
| 2006/0008513 | A1 | 1/2006 | Holbert et al. |
| 2006/0051603 | A1 | 3/2006 | Cleveland et al. |
| 2006/0070959 | A1 | 4/2006 | Perkins et al. |
| 2006/0122318 | A1 | 6/2006 | Jho et al. |
| 2006/0138058 | A1 | 6/2006 | Barak |
| 2006/0154978 | A1 | 7/2006 | Barak |
| 2006/0191851 | A1 | 8/2006 | Mizuno et al. |
| 2006/0231505 | A1 | 10/2006 | Mayer et al. |
| 2007/0034346 | A1 | 2/2007 | Salm |
| 2007/0045199 | A1 | 3/2007 | Mayer et al. |
| 2007/0049642 | A1 | 3/2007 | Singleton et al. |
| 2007/0060754 | A1 | 3/2007 | Lindstrom et al. |
| 2007/0131368 | A1 | 6/2007 | Xia |
| 2007/0178173 | A1 | 8/2007 | Rice et al. |
| 2007/0196602 | A1 | 8/2007 | Kim et al. |
| 2007/0237868 | A1 | 10/2007 | Howarth |
| 2007/0251889 | A1 | 11/2007 | Singleton et al. |
| 2007/0256986 | A1 | 11/2007 | Singleton et al. |
| 2007/0256987 | A1 | 11/2007 | Singleton et al. |
| 2007/0259938 | A1 | 11/2007 | Barak |
| 2008/0003305 | A1 | 1/2008 | Barak |
| 2008/0017337 | A1 | 1/2008 | Duggirala et al. |
| 2008/0035291 | A1 | 2/2008 | Bacon et al. |
| 2008/0169202 | A1 | 7/2008 | Bargeman et al. |
| 2008/0181815 | A1 | 7/2008 | Cheng et al. |
| 2008/0196853 | A1 | 8/2008 | Rice |
| 2008/0199969 | A1 | 8/2008 | Rice |
| 2008/0216008 | A1 | 9/2008 | McCampbell et al. |
| 2008/0269337 | A1 | 10/2008 | Breen et al. |
| 2009/0050575 | A1 | 2/2009 | Barak |
| 2009/0107923 | A1 | 4/2009 | Barak |
| 2009/0173697 | A1 | 7/2009 | Axtell et al. |
| 2009/0214674 | A1 | 8/2009 | Barraud |
| 2010/0043989 | A1 | 2/2010 | Shannon et al. |
| 2010/0096340 | A1 | 4/2010 | Barak |
| 2010/0119620 | A1 | 5/2010 | Rice et al. |
| 2010/0183746 | A1 | 7/2010 | Barak |

PAPERBOARD CONTAINING RECYCLED FIBERS AND METHOD OF MAKING THE SAME

CROSS-REFERENCE TO RELATED APPLICATIONS

This application is a divisional application of U.S. patent Ser. No. 12/883,506, filed Sep. 16, 2010, which claims the benefit of U.S. Provisional Application No. 61/244,597, filed Sep. 22, 2009, U.S. Provisional Application No. 61/247,720, filed Oct. 1, 2009, U.S. Provisional Application No. 61/253,184, filed Oct. 20, 2009, and U.S. Provisional Application No. 61/348,443, filed May 26, 2010, all which are incorporated by reference herein in their entirety.

TECHNICAL FIELD

This disclosure is directed generally to paper or paperboard formed from recycled waste material, for example, including up to 100% recycled fibers, a method or process for making the paper or paperboard, and various articles formed from the paper or paperboard.

BACKGROUND

There is an increasing demand for paper-based products (e.g., paper, paperboard, and/or articles made therefrom) made at least partially from recycled waste material. There also is a demand for increasing the post-consumer waste (PCW) content of the recycled fibers used in such products. However, some types of PCW fibers may have a microorganism content (e.g., vegetative bacteria, endospores, fungi, etc.) that may be two to three orders of magnitude greater than that of virgin (i.e., non-recycled) fibers. Recycled fibers, in particular, PCW fibers, may also contain a significantly larger quantity of endospores than virgin fibers. Accordingly, the level of microorganisms must be reduced when the paper or paperboard is used for making products that are intended for low microorganism direct food contact (LMDFC) applications, for example, for being in contact with aqueous and/or fatty foods. Thus, there remains a need for paper or paperboard formed from up to 100% recycled waste materials for use in LMDFC applications. There is a further need for such a paper or paperboard including up to 100% PCW fibers. There also remains a need for methods of making the paper or paperboard and products formed from the paper or paperboard for LMDFC applications.

SUMMARY

This disclosure is directed to paper or paperboard (hereinafter generally referred to as "paperboard") formed from recycled waste material. The paperboard may include up to 100% recycled fibers, and each of various examples, may include from greater than 10% to 100% recycled fibers, from greater than 30% to 100% recycled fibers, or in one particular example, may include 100% recycled fibers. The paperboard may be suitable for forming products for low microorganism direct food contact (LMDFC) applications. The paperboard may have a microorganism level of less than 5,000 colony forming units (cfu)/g of paperboard (including vegetative bacteria, endospores, fungi, etc.), as measured using "Disintegration Method," Standard Methods for the Examination of Dairy Products, 17$^{th}$ Edition, 2004, 13.042 (in which organisms growing on plate count agar after 48 hrs. of incubation are measured) (hereinafter referred to as the "Disintegration Method").

In one aspect, the papermaking furnish (or simply "furnish," i.e., the incoming materials), the resulting paperboard, and/or an article formed therefrom may contain up to 100% post-consumer waste (PCW) fibers.

In another aspect, the fibers may be bleached, unbleached (e.g., from old corrugated containers (OCC)), or any combination thereof. In some exemplary embodiments, the furnish, paperboard, and/or article formed therefrom may include up to 40% unbleached fibers, for example, from about 15 to about 30% unbleached fibers. In one particular example, the furnish, paperboard, and/or article formed therefrom may comprise about 25% unbleached fibers.

The paperboard may be used to form numerous articles, for example, cups, plates, bowls, trays, platters, or other foodware or pressware, ovenable containers, freezer containers, food service containers (e.g., for fast food restaurants or carryout containers), food packages (e.g., for ice cream, frozen yogurt, or otherwise), or any other suitable article.

This disclosure is also directed generally to a method of forming paperboard from recycled waste material, including up to 100% recycled fibers, suitable for use in LMDFC applications. In one example, the method may comprise continuously (or substantially continuously) treating the recycled fibers with one or more biocides. Haloamine biocides, including chloramines, bromamines, bromine activated chloramines, organic haloamines, etc., may be suitable; however, other biocides may be used. Although it is known to use biocides to reduce the microbial level of process waters to minimize slime growth on the equipment, such biocides typically are not used to reduce the number of colony forming units of microorganisms in the resulting product. Accordingly, it was completely unexpected that conventional biocides could be used to reduce microorganism levels in recycled paperboard to render the paperboard suitable for LMDFC applications.

Other features, aspects, and embodiments will be apparent from the following description and accompanying figures.

DESCRIPTION

Figure 1:
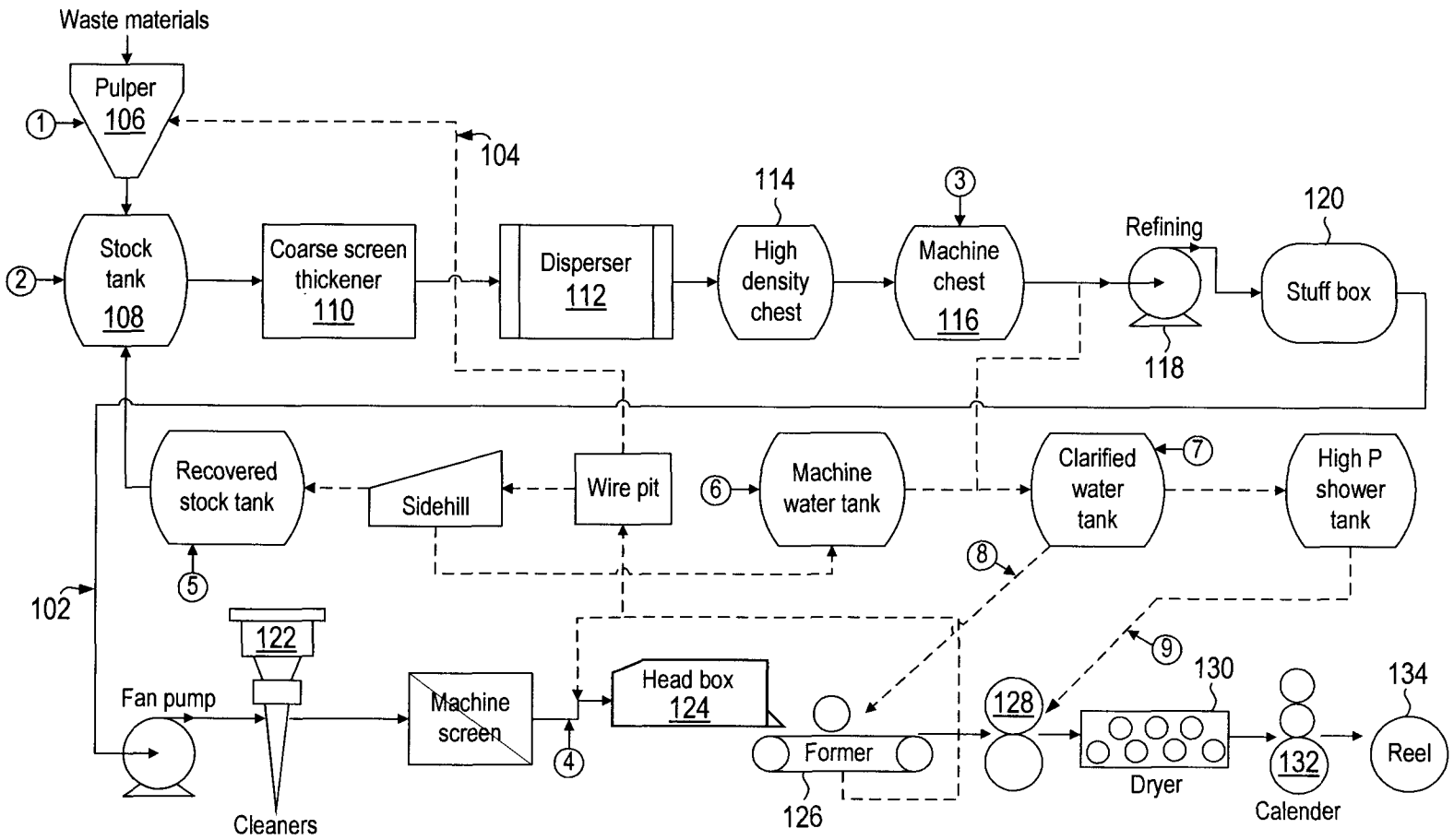
FIG. 1 is a schematic representation of an exemplary process for forming paperboard.

This disclosure is directed generally to paperboard formed from recycled waste material (i.e., recycled fibers), articles formed from the paperboard, and a method of making the paperboard. While paperboard is discussed in detail herein, the present disclosure is likewise applicable to paper.

In one aspect, the furnish, resulting paperboard, and/or article formed from the paperboard may include from greater than 0% to 100% recycled fibers. In each of various independent examples, the furnish, paperboard, and/or article formed from the paperboard may include about 5%, about 10%, about 15%, about 20%, about 25%, about 30%, about 35%, about 40%, about 45%, about 50%, about 55%, about 60%, about 65%, about 70%, about 75%, about 80%, about 85%, about 90%, about 95%, or 100% recycled fibers, at least about any of such amounts (e.g., at least about 35%, at least about 50%, at least about 75%, at least about 95%, and so on), greater than any of such amounts (e.g., greater than 60%, greater than 75%, greater than 90%, and so on), or any suitable amount or range of amounts. In one particular example, the paperboard may include from greater than 10% to 100% recycled fibers. In another particular example, the paperboard may include from greater than 30% to 100% recycled fibers.

The level of microorganisms in the paperboard may be sufficiently low such that the paperboard is suitable for use in low microorganism direct food contact (LMDFC) applications. In one example, the paperboard may have a microorganism level of less than about 5,000 cfu/g paperboard (including vegetative bacteria, endospores, fungi, etc.) as measured using the Disintegration Method. In each of various other independent examples, the paperboard may have a microorganism level of less than about 4,500 cfu/g, less than about 4,000 cfu/g, less than about 3,500 cfu/g, less than about 3,000 cfu/g, less than about 2,500 cfu/g, less than about 2,000 cfu/g, less than about 1,500 cfu/g, less than about 1,000 cfu/g, less than about 500 cfu/g, or less than about 250 cfu/g. However, other microorganism levels are contemplated.

Any suitable recycled waste material may be used to form the paperboard. For example, the recycled waste material may include post-industrial waste (PIW) (e.g., plate stock, and double lined Kraft (DLK), etc.), post-consumer waste (PCW) (e.g., sorted office paper (SOP), deinked mixed office waste, sorted white ledger (SWL), old corrugated containers (OCC), double sorted corrugated containers (DS OCC), tube scrap, residential mixed paper, news, etc.), any other type of waste paper, or any combination thereof. Virgin materials also may be used. The level of each type of waste material used for each application may vary. Accordingly, the level of each type of fibers in the resulting paperboard (and articles formed from the paperboard) likewise may vary.

Fibers derived from any of the above recycled waste materials, or from any other suitable recycled or virgin materials, may be present in the furnish, paperboard, and/or article formed from the paperboard in any suitable amount. Thus, by way of example, any of such fibers may comprise 0%, about 5%, about 10%, about 15%, about 20%, about 25%, about 30%, about 35%, about 40%, about 45%, about 50%, about 55%, about 60%, about 65%, about 70%, about 75%, about 80%, about 85%, about 90%, about 95%, or 100% of the furnish, paperboard, and/or article formed from the paperboard, or at least about any of such amounts (e.g., at least about 25%, at least about 45%, at least about 85%, and so on), greater than any of such amounts (e.g., greater than 40%, greater than 70%, and so on), or any suitable amount or range of amounts.

Thus, by way of illustration, the furnish, paperboard, and/or article formed from the paperboard may include up to 100% PCW fibers, for example, from greater than 0% to 100% PCW fibers, for example, from greater than 10% to 100% PCW fibers, for example, from greater than 30% to 100% PCW fibers. Further, in each of various independent examples, the furnish, paperboard, and/or article formed from the paperboard may include about 10%, about 15%, about 20%, about 25%, about 30%, about 35%, about 40%, about 45%, about 50%, about 55%, about 60%, about 65%, about 70%, about 75%, about 80%, about 85%, about 90%, about 95%, or 100% PCW fibers, at least about any of such amounts (e.g., at least about 50%, at least about 60%, at least about 80%, and so on), greater than any of such amounts (e.g., greater than 75%, greater than 80%, and so on), or any suitable amount or range of amounts. All or a portion of the PCW may be chemically pulped fibers or semi-chemical pulped, or even mechanically pulped fibers, such as ground wood fibers. Other possibilities are contemplated with different types of fibers.

The fibers used may be bleached or unbleached, and such fibers may be present in any suitable amount and/or proportion. In some embodiments, the furnish, paperboard, and/or article formed from the paperboard may include up to 100% bleached fibers (e.g., from SOP or any other suitable source), for example, from greater than 0% to 100% bleached fibers, for example, from greater than 10% to 100% bleached fibers, for example, from greater than 30% to 100% bleached fibers. Accordingly, in each of various independent examples, the furnish, paperboard, and/or article formed from the paperboard may include about 5%, about 10%, about 15%, about 20%, about 25%, about 30%, about 35%, about 40%, about 45%, about 50%, about 55%, about 60%, about 65%, about 70%, about 75%, about 80%, about 85%, about 90%, about 95%, or 100% bleached fibers, or at least about any of such amounts (e.g., at least about 25%, at least about 45%, at least about 65%, and so on), greater than any of such amounts (e.g., greater than 55%, greater than 80%, and so on), or any suitable amount or range of amounts.

In some embodiments, the furnish, paperboard, and/or article formed from the paperboard may include up to 40% unbleached fibers (e.g., from OCC or any other suitable source). Accordingly, in each of various independent examples, the furnish, paperboard, and/or article formed from the paperboard may include about 5%, about 10%, about 15%, about 20%, about 25%, about 30%, about 35%, or about 40% unbleached fibers, at least about any of such amounts (e.g., at least about 20%, at least about 35%, at least about 35%, and so on), greater than any of such amounts (e.g., greater than 15%, greater than 20%, and so on), or any suitable amount or range of amounts. In other embodiments, the furnish, paperboard, and/or article formed from the paperboard may include from about 10 to about 40% unbleached fibers, for example, from about 15 to about 30% unbleached fibers, for example, about 25% unbleached fibers.

It will be appreciated that the level of microorganisms in each of the various virgin and recycled materials may vary. Accordingly, the manner in which the paperboard is made and the resulting microbial level may depend on the composition of the furnish, the requirements for the particular LMDFC application, and any applicable standards and/or regulations, as will be discussed further below. In view of the following discussion, it will become apparent that the raw materials, biocide, processing time, and processing temperature, and numerous other variables must be selected carefully to produce paperboard suitable for LMDFC applications.

An exemplary papermaking process 100 is illustrated schematically in FIG. 1, where the stock stream 102 (i.e., the stream carrying dispersed fibers to the head box) is shown with solid lines, and the white water stream 104 (i.e., the stream carrying water and residual fibers from the forming section back to the pulper and to various other parts of the process) is shown with dashed lines. The process 100 may also include one or more fresh water streams. Although one exemplary process is shown herein, it will be understood that numerous other process steps may be added or omitted.

In the illustrated process 100, the furnish (including various recycled waste materials and/or virgin fibers) is conveyed to one or more pulpers 106, where the materials are pulped into a fiber suspension or slurry. Different furnish types may be either dry blended (where various bales are arranged in a predetermined, repeated pattern on a conveyer) or wet blended (where slurry streams from different pulpers are blended into a chest). The furnish formula may be determined by the average weight of the bales for a dry blended furnish, or by solid content and flow rate of each furnish stream for a wet blended furnish. The resulting suspension or slurry then may be sent to a stock tank 108 to await further processing.

The slurry may then pass through one or more screens and cyclones (not shown) to remove any fiber bundles or non-fibrous debris such as plastic and metal particles. The remaining fibers in the slurry then may be pumped to a thickener 110 such as a screw press or a two stage screw press arrangement where the fiber consistency in the slurry is increased (e.g., from about 4% to greater than 20%). The thick stock may then be fed through a vertical shredder which fluffs the pulp. The treated pulp is then mixed with steam in a pre-heater before being fed to a disperser 112 where extensive mechanical friction between the fibers reduces the size of large contaminants in the fibers suspension so that any such contaminants are less visible and their adverse effects are nullified when in the resulting paperboard. The fiber dispersion may then be diluted with white water and sent to a storage tank, for instance, a high density chest 114. The thick stock may be diluted further at the bottom of the high density chest 114 as the stock awaits further processing.

As shown in FIG. 1, the stock may be sent to a machine chest 116 and, typically, to a series of refiners 118 where fiber length and surface morphology are modified to enhance fiber-to-fiber bonding. The refined stock then may be fed to an elevated tank called a "stuff box" 120, which creates a constant hydraulic pressure (and thus a steady flow), leading to the "approach system," in which the fiber suspension is metered, diluted, mixed with various chemical additives, and further cleaned and screened. In one example of an approach system, the fiber suspension may be introduced into a fan pump loop where it is blended with white water in a controlled fashion. The diluted stock then may pass through a series of forward and reverse cleaners 122 to further remove contaminants that are heavier or lighter than fibers by centrifugal force. The stock then passes through a final screen called machine screen to further remove debris to protect the paper machine equipment. From there, the dispersion may be fed to the headbox 124 and laid onto a forming wire 126 (or a set of forming wires in case of a multiply paper machine) to form a wet web of fibers. The wet sheet is then pressed in a press section for additional water removal and for sheet consolidation as it passes between a series of two roll press nips 128, and dried on the surfaces of heated cylindrical dryer cans 130. Typically, the dried paper passes through one or more calendar stacks 132, to improve board smoothness and cross machine uniformity. The calendered board is then wound into a roll on a reel 134.

If desired, one or more biocides may be used to reduce the level of microorganisms in the paperboard to render the resulting paperboard suitable for LMDFC applications. Although it is known to use a biocide in a papermaking process, the present process differs from the conventional use of biocide in papermaking processes in several ways. First, with conventional biocide treatment, the primary objective is to reduce actively growing microorganisms that are responsible for slime deposition and sheet breaks. In sharp contrast, the process of this disclosure seeks to reduce the number of colony forming units in the resulting paperboard (predominately endospores, since the drying section of a typical paper machine kills most of the vegetative microorganisms). The ability of standard biocides to achieve this was quite unexpected. Further, with conventional biocide treatment, the microorganisms do not have to be maintained below a certain level in the water or stock streams at all times, as long as the slime growth activities are inhibited. Conversely, the present process seeks to inhibit microbial growth at many or all stages of the process to ensure that the resulting paperboard consistently meets the requirements for the particular LMDFC application.

The ease or difficulty of treating a particular furnish composition may depend on numerous factors including, for example, the inherent microorganism level of each type of fiber, the presence of agents that facilitate or hinder microorganism reduction, and/or the requirements for the specific LMDFC application. For example, virgin fibers typically contain relatively few microorganisms as compared with recycled fibers. Additionally, where the virgin fibers are bleached, it is believed that in some cases, the bleached virgin fibers may include a residual oxidant from the bleaching process that may serve as a biocide. Thus, it may be easier to achieve the desired microorganism level where virgin fibers are a component of the furnish composition, and even easier where the virgin fibers are bleached, as compared with using recycled fibers. Finally, it will be appreciated that in conventional processes that use virgin fibers, there tends to be a greater amount of fresh water used than in processes that use recycled fibers. As a result, virgin paperboard processes tend to have cleaner water that is less prone to microbial growth, as compared with recycled paperboard processes in which the nutrients present in the water often facilitate microorganism growth. Recycled paperboard processes also may contain more organic materials that increase the demand for oxidants and biocides.

As another example, among the various types of recycled fibers, bleached PCW fibers (e.g., from sorted office waste, deinked mixed office waste, and/or sorted white ledger) generally have fewer microorganisms than unbleached PCW fibers. This may be particularly true where the unbleached PCW includes OCC fibers, since the starch based adhesive often used to glue the corrugated medium to the linerboard may serve as a food source for microorganisms and, therefore, may support extensive microbial growth. Unbleached fibers also may be more difficult to treat because the fibers often contain chemical components (e.g., lignin) that react with oxidizing biocides and render the biocide less effective. Thus, more biocide may be needed to achieve the same reduction in microorganisms. In contrast, bleached fibers (virgin or recycled) are easier to treat because the bleaching process neutralizes these components so the oxidizing biocide is more effective. Thus, it may be easier to achieve the desired microorganism level where bleached PCW is used, as compared with unbleached PCW.

In view of the above factors and numerous others, it can generally be stated that bleached virgin fibers are among the easiest to treat and OCC fibers are among the most difficult to treat. Accordingly, since the present inventors have developed a process for successfully reducing the microbial level of compositions including OCC fibers, it will be appreciated that the process of the present disclosure also may be used to successfully treat other types of fibers that are inherently easier to treat. By way of example and not limitation, if a particular set of process conditions (e.g., according to this disclosure, although numerous other process conditions are contemplated) can be used to successfully treat a furnish including about 40% OCC fibers (which are unbleached PCW fibers) and about 60% bleached PIW fibers, it is expected that the process could also be used to successfully treat a furnish including 100% PCW, for example, 100% bleached PCW fibers, or as another example, up to about 40% OCC fibers and at least about 60% bleached PCW fibers. Although the bleached PCW fibers may have a higher microorganism level than bleached PIW fibers, the bleached PCW fibers typically do not contain the reducing agents present in OCC fibers that may impede the effectiveness of an oxidizing biocide. Thus, it is expected that the teachings of the present disclosure can be used to successfully form paperboard for LMDFC applications from a variety of starting materials. Other examples are contemplated.

If desired, the biocide or biocides may be introduced in a continuous or substantially continuous (sometimes generally referred to as "continuous") manner at multiple addition points throughout the process. The number and location of biocide addition points may be selected to ensure that a sufficient quantity of biocide is present to reduce the presence of microorganisms, for example, as needed for a particular LMDFC application. At the same time, the total amount of biocide being introduced into the process at each location may be selected to ensure that any applicable EPA standards are met.

By way of illustration, and not limitation, as stated previously, in a typical papermaking process, chloramine (e.g., monochloramine) may be added periodically to enhance machine runnability, for example, to prevent sheet breaks and slime spots. Typically, the chloramine is added to the process in cycles. While this periodic or cyclic addition of chloramine may generally be sufficient to prevent slime growth, the present inventors have determined that a conventional cyclic treatment method is insufficient for forming paperboard for LMDFC applications. First, paperboard formed using cyclic treatment has been shown to have highly variable numbers of microorganisms throughout the cycle. While not wishing to be bound by theory, it is believed that this variability is a result of different concentrations of chloramine (and therefore microorganism growth) at various stages in each cycle and thus at various points in the process. As discussed above, some types of PCW fibers (e.g., unbleached PCW fibers such as OCC fibers) require a higher dosage of chloramine than other types to sufficiently reduce the level of microorganisms for LMDFC applications. Because of the difference in demand of chloramine among the PCW components, any change in the PCW composition in the incoming furnish may result in a fluctuation in the microorganism count in the resulting paperboard. (It will be appreciated that changes in furnish types that require high demand of chloramine, such as OCC fibers, have more profound effect than the furnish types that require low demand of chloramine.) Further, because some of the microorganisms may survive and grow during the "off" periods of the cyclic addition in various locations, microorganism levels in the resulting paperboard may increase and have been shown to exceed maximum levels needed for LMDFC applications (e.g., 5,000 cfu/g).

Second, it is known that the use of biocides may be regulated by the Environmental Protection Agency (EPA) (and/or in some cases the Food and Drug Administration). For example, where some chloramine products are used, the level of residual chlorine in the process waters may not exceed 5 ppm. (It is noted that the standard for one exemplary chloramines product is discussed in detail herein for purposes of discussion and not limitation. Other standards may apply for different chloramines products and for other biocides, and such standards may or may not be based on residual limits.) Thus, when using chloramine to treat the furnish, the residual level must be strictly controlled. In contrast, the chlorine residual limit is of little concern in a conventional treatment process in which chloramine is used merely to prevent slime growth. In such conventional processes, chloramine typically is added in cycles, for example, from about 0.45 to 0.85 lb/ton on a periodic basis (for example, once per hour with treatment lasting from about 5 to about 15 min), such that the level of residual chlorine rarely exceeds 2 ppm.

However, the present inventors have determined that significantly higher levels of chloramine are needed to reduce the microorganism level to form paperboard from recycled materials for LMDFC applications. If the average chloramine level is increased sufficiently to meet the cfu/g requirement, and if the chloramine is introduced into the process using a cyclic addition method, the sudden increase in biocide concentration during the treatment period of the cycle may cause a spike in chlorine residual levels, thereby exceeding the 5 ppm limit established by the EPA.

In sharp contrast, the present inventors have found that by adding the chloramine in a continuous manner at multiple addition points throughout the process, more chloramine can be introduced into the process at a given time without exceeding the EPA residual chlorine limits. Using this unconventional approach, the present process provides a greater potential for reducing the microorganism level of the resulting paperboard. Thus, a greater amount of recycled fibers, for example, unbleached recycled fibers (e.g., from OCC) can be used for LMDFC applications. For example, as stated above, the paperboard may include from greater than 0% to 100% recycled fibers, all or a portion of which may comprise PCW. In some examples, the paperboard may also include up to 40% unbleached fibers (e.g., OCC fibers), for example, from about 20% to about 30% unbleached fibers.

The precise amount of biocide added at each location may vary for each process depending on the type of biocide used, the microorganism limit for the particular product, the composition of the furnish, the number and arrangement of process steps and pipes, dwell time in each pipe or vessel, fiber concentration, ability to achieve adequate mixing, process and dry section temperature, chemical additives applied, any applicable regulations, and numerous other factors. Thus, the scope of this disclosure is not limited by such variables or factors. Additionally, it will be appreciated that since each biocide may be subject to different regulations, the manner in which a particular biocide is used in a particular process may vary.

For example, where the biocide is chloramine, the number and location of addition points, the amount of biocide delivered to each addition point, and the total amount of biocide delivered to the process may be selected to ensure that the number of microorganisms is sufficiently reduced without exceeding the EPA residual chlorine limit. Thus, fewer or more addition points may be needed to ensure that the biocide (e.g., chloramine) is being consumed (i.e., used) at a sufficiently high rate. While not wishing to be bound by theory, it is believed that in some embodiments, the maximum biocide efficacy may be achieved when the level of biocide in both the stock and white water streams is maintained just below the maximum allowed residual level of chlorine at all times. Further, since the biocide acts rapidly, it is generally believed that for a given process, a greater number of addition points will result in a greater overall treatment efficacy. However, it is contemplated that fewer addition points may be suitable for some processes.

If desired, the addition points may be selected so that the biocide may be continuously added or delivered to the stock stream, the white water stream, and/or one or more fresh water streams. The amount and ratio of biocide delivered to the respective streams may vary for each process. The precise amounts and ratios used may depend on the type of biocide being used, the particular process, and numerous other factors.

Additionally or alternatively, the addition points may be selected based on the dwell time in each vessel, since longer dwell times increase the potential for microorganism growth. For example, the biocide may be added to one or more vessels having a retention time of at least about 3 minutes. In other examples, the biocide may be added to each vessel having a retention time of at least about 4 minutes. In still other examples, the biocide may be added to each vessel having a retention time of at least about 5 minutes.

It will be appreciated that there may be exceptions, depending on various factors including the type of biocide used. For example, where the biocide may potentially cause an inhalation hazard, the addition points may be limited to closed vessels. Alternatively, open vessels may be treated with a biocide that contains little or no volatile organic compounds (VOCs) and/or causes little or no vapor phase corrosion. As another example, the addition points may be selected to maintain the biocide below a temperature at which the biocide may degrade or otherwise be rendered ineffective.

It will also be appreciated that the addition points may be selected so that one or more ancillary streams (e.g., additive streams) are treated with the biocide. This may include streams used during the dry end processing, such as coatings or surface sizing. It will be noted that this differs from the conventional use of biocides (for preventing slime growth, etc.) in which the presence of microorganisms in the dry end of the process is largely inconsequential.

By way of illustration, and not limitation, in the exemplary process 100 of FIG. 1, one or more biocides may be introduced continuously into the process at nine addition points or locations, numbered (1)-(9), namely, the pulper (1), stock tank (2), machine chest (3), the head box inlet stream (4), recovered stock tank (5), machine water tank (6), clarified water tank (7), shower water stream for the former (8), and shower water for felt (9). Thus, in this example, five addition points (1)-(5) are used to deliver biocide to the stock and four addition points (6)-(9) are used to deliver biocide to the white water. This ensures that the incoming furnish is treated promptly, before microorganism numbers can increase, and that any residual microorganism growth and/or accumulation is minimized throughout the process. However, it will be appreciated that other processes may require fewer or greater addition points.

By way of example, in the illustrated process, the pulper 106 (addition point (1)) may be an open vessel, and may be treated with a biocide that does not pose an inhalation hazard, for example, isothiazolin (discussed below). The vessels at each of the remaining addition points (2)-(9) may be closed vessels having a retention time of at least about 3 minutes, and therefore, may be treated with a haloamine, for example, monochloramine. Some or all of the remaining vessels, for example, the refiners, screens, cleaners, stuff box, and side hill may have a retention time of less than about 3 minutes and/or may be open vessels, and therefore, may be untreated. Further, the temperature of the stock at the disperser 112 and the high density (HD) chest 114 may be at temperature of where the degradation rate of chloramine is too high for it to be effective as a biocide, and therefore, may remain untreated. (However, where the retention time in the HD chest is sufficiently long that the stock has time to cool down, the HD chest may be treated.) Other possibilities are contemplated. It will be appreciated that each process may differ and therefore, the vessels that are treated may likewise differ. Thus, the examples provided herein should be considered to be illustrative only.

Although chloramine is discussed in detail herein, any suitable biocide or combination of biocides may be used, and any of such biocides may have any suitable mode of action. Suitable biocides may include oxidizing biocides, non-oxidizing biocides, or any combination thereof. Examples of oxidizing biocides that may be suitable include, but are not limited to, chlorine, hydrogen peroxide, chlorine dioxide, sodium hypochlorite, sodium hypobromite, ammonium bromide, hypobromous acid, peracetic acid, chloramine, and bromine activated chloramine. It will be noted that peracetic acid, chloramine, and bromine activated chloramine are examples of stabilized oxidizing biocides, which are not strong oxidizers compared to other oxidizing biocides and have limited adverse impact on dyes, sizes, and other polymer additives.

Where chloramine is used, in each of various independent examples, the chloramine may be added to the stock stream, white water stream, fresh water stream(s), and/or any other streams in any suitable total amount (on an active ingredient basis), for example, from about 0.1 to about 10 lb/ton of paperboard, from about 0.5 to about 7 lb/ton of paperboard, from about 0.75 to about 5 lb/ton of paperboard, or from about 2 to about 4 lb/ton of paperboard. In one specific example, the chloramine may be used in an amount of from about 2.4 to about 3.6 lb/ton of paperboard on an active ingredient basis. However, other amounts and ranges of amounts are contemplated for chloramine and other oxidizing biocides.

Further, where the oxidizing biocide is added to both the stock stream and the white water stream, the oxidizing biocide may be added to the stock stream and the white water stream (or other streams) in any suitable relative amounts. In one example in which chloramine is used, the chloramine may be added to the stock stream and the white water stream in a ratio of from about 1:10 to about 10:1 on active ingredient basis, for example, from about 3:1 to about 7:1. However, other ratios and ranges of ratios are contemplated. It will be noted that although the above amounts and ranges are described in connection with chloramine, such ranges and amounts may be equally applicable for other oxidizing biocides. Likewise, other ratios, amounts, and ranges of ratios and amounts are contemplated for chloramine and other oxidizing biocides.

Examples of non-oxidizing biocides that may be suitable include, but are not limited to, gluteraldyhyde, the ADBAC quats, DBNPA, dodecylguanidine hydrochloride, thiazoles, thiocyanates, cyannobutane, thione, dithiocarbamate, some bromo-compounds, and glyceralderhyde. However, any suitable biocide or combination of biocides may be used. In one exemplary embodiment, a non-oxidizing biocide may be added to the stock stream in the pulper (e.g., pulper 106), as discussed above. While not wishing to be bound by theory, it is believed that non-oxidizing biocides may be effective at reducing the number of dormant endospores in the pulp.

One particular example of a non-oxidizing biocide that may be suitable is Busan® 1078 isothiazolin biocide (1.5% isothiazolin active ingredient) (Buckman Laboratories International, Inc., Memphis, Tenn.). The isothiazolin may be added in any suitable amount, for example, from about 0.0075 to 0.050 lb/ton of paperboard on active ingredient basis, from about 0.010 to about 0.035 lb/ton of paperboard, or from about 0.015 to about 0.040 lb/ton of paperboard, for example, about 0.0225 lb/ton of paperboard. Although such amounts and ranges are described in connection with isothiazolin such ranges and amounts may be equally applicable for other non-oxidizing biocides. Alternatively, other amounts and ranges may be suitable for isothiazolin and other non-oxidizing biocides.

Where a combination of biocides (i.e., a "biocide system") is used, the biocides may be introduced into the process together via one or more of the same addition points, or may be introduced into the process via different addition points. For example, as mentioned above with respect to the exemplary process illustrated schematically in FIG. 1, a non-oxidizing biocide (e.g., isothiazolin) may be added to the pulper 106 (e.g., addition point (1)), while an oxidizing biocide (chloramine) may be added at various points downstream of the pulper (e.g., addition points (2)-(9)). In another embodiment, a non-oxidizing biocide (e.g., isothiazolin) may be added to the pulper 106, while one or more oxidizing biocides (e.g., chloramine, chlorine, and/or hypochlorite, etc.) may be added at one or more of various points downstream of the pulper (e.g., addition points (2)-(9)). In still other embodiments, the non-oxidizing biocide may be omitted. Other possibilities are contemplated. Also, in some processes, one or more biocides may be added continuously and one or more of the biocides may be added cyclically.

Likewise, the total amount of biocide used to treat the furnish may vary for each application, depending on the composition of the recycled waste materials, numerous other process variables, and/or any applicable regulatory requirements. In some examples, the biocide (e.g., a biocide system including monochloramine and isothiazolin) may be used in an amount of from about 0.5 to about 7 lb/ton of paperboard, for example, from about 0.75 to about 5 lb/ton of paperboard, for example, from about 2 to about 4 lb/ton of paperboard. In one specific example, the biocide system may be used in an amount of from about 2.5 to about 3.7 lb/ton of paperboard. Although such amounts and ranges are described in connection with an exemplary biocide system including monochloramine and isothiazolin, such ranges and amounts may be equally applicable for other biocides and biocide systems. Likewise, other amounts and ranges of amounts are contemplated for monochloramine and isothiazolin and other biocide systems.

If desired, the biocide(s) may be introduced into the process for a predetermined length of time prior to making the paperboard to minimize the level of any pre-existing microorganisms in the system, for example, any microorganisms adhering to process equipment and pipe lines. For example, a period of one to three days may be sufficient to purge the system. Other purge times are contemplated.

Additionally or alternatively, the temperature of the fiber suspension may be raised in one or more process units such as a disperser and a stand pipe with steam to further reduce the number of vegetative microorganisms. For example, the temperature of the fiber suspension may be raised to about 180° F. to about 200° F.

It will be appreciated that numerous processing additives may be used to form the paperboard, for example, wet or dry strength additives (e.g., native or modified starch and other synthetic polymers), defoamers, drainage aids, retention aids, felt washing and/or conditioning agents, stickies removal or dispersing agents, and so on. Pigments and mineral particles such as titanium dioxide, clay, and calcium carbonate may be added in the coating formulas to improve brightness, smoothness, and printability in general. If desired, starch, carboxyl methylcellulose, polyvinyl alcohol, and/or other polymers may be added to prevent linting and/or to increase surface fibers bonding and board stiffness. In addition, alkyl ketene dimer (AKD), alkyl succinic anhydride (ASA), rosin, or other chemicals also may be used to control liquid absorption, to minimize grease penetration, and to prevent wicking. Each of these additives may introduce microorganisms into the process. Therefore, it is contemplated that one or more of such streams may also be treated with biocide when making paperboard for LMDFC applications. This again illustrates the importance of engineering the biocide and its application to a particular process to form paperboard suitable for LMDFC applications.

The resulting paperboard may have any suitable basis weight or caliper and may be used to form numerous articles, some of which are set forth above. For example, the paperboard may comprise from about 7 pt (0.007 inches thick) to about 22 pt (0.022 inches thick) paperboard, for example, from about 11 pt (0.011 inches thick) to about 19 pt (0.019 inches thick) paperboard. In one specific example, the paperboard may comprise 11.3 pt (0.0113 inches thick) paperboard. In still another specific example, the paperboard may comprise 18.5 pt (0.0185 inches thick) paperboard. In some cases, the paperboard may be coated with one or more materials to impart additional properties to the article. For example, the paperboard may be coated with a polymer such as polyethylene, wax, polylactic acid or other liquid impervious coating to form an item intended for contact with a food item. However, other possibilities are contemplated.

It will be appreciated that since other components may be added during formation of the article (e.g., structural components, coatings, additional layers, and so on), the total recycled fiber content of the finished article may differ from that of the raw (e.g., uncoated) paper or paperboard. Thus, in each of various independent examples, the article may have a recycled fiber content of at least about 5%, at least about 10%, at least about 15%, at least about 20%, at least about 25%, at least about 30%, at least about 35%, at least about 40%, at least about 45%, at least about 50%, at least about 55%, at least about 60%, at least about 65%, at least about 70%, at least about 75%, at least about 80%, at least about 85%, at least about 90%, at least about 95%, or 100% by weight of the article. The percentage of PCW fibers in the article may likewise be at least about 5%, at least about 10%, at least about 15%, at least about 20%, at least about 25%, at least about 30%, at least about 35%, at least about 40%, at least about 50%, at least about 55%, at least about 60%, at least about 65%, at least about 70%, at least about 75%, at least about 80%, at least about 85%, at least about 90%, at least about 95%, or 100% by weight of the article. The percentage of bleached fibers in the article independently may likewise be at least about 5%, at least about 10%, at least about 15%, at least about 20%, at least about 25%, at least about 30%, at least about 35%, at least about 40%, at least about 50%, at least about 55%, at least about 60%, at least about 65%, at least about 70%, at least about 75%, at least about 80%, at least about 85%, at least about 90%, at least about 95%, or 100% by weight of the article. Likewise, the percentage of unbleached fibers (e.g., OCC fibers) in the article may be at least about 5%, at least about 10%, at least about 15%, at least about 20%, at least about 25%, at least about 30%, at least about 35%, or at least about 40% by weight of the article. Other percentages are contemplated.

The present invention may be understood further in view of the following examples, which are not to be limited in any manner. All values are approximate unless expressly noted.

EXAMPLES

Multiple trials (Trials A-D) were conducted using two biocides to form various grades of paper or paperboard using a process similar to the process illustrated schematically in FIG. 1. In each trial, 100% recycled furnish was used, with a target of from 0% to about 35% PCW and from about 65% to 100% bleached PIW content.

A non-oxidizing biocide (Busan 1078 isothiazolin biocide (1.5% isothiazolin) Buckman Laboratories International, Inc., Memphis, Tenn.) was continuously added to the pulper (FIG. 1, addition point (1)) in an amount of about 1.5 lb/ton of pulp on an "as received" concentration basis (or about 0.0225 lb/ton actives). An oxidizing biocide (monochloramine) also was added using either cyclic addition or continuous addition to addition points (2)-(9) (FIG. 1), as indicated in Table 1. The monochloramine was formed by combining Busan® 1215 ammonia (7.59% actives) (Buckman Laboratories International, Inc.) with sodium hypochlorite with 1% alkalinity (12.50% actives) (Hydite Chemical Co., Brookfield, Wis.). Two mixers were used. Mixer 1 delivered the monochloramine to addition points (2) and (3). Mixer 2 delivered the monochloramine to addition points (4)-(9). Where cyclic treatment was used, the biocide was added to each addition point in a consecutive manner, with each addition point being treated for about 2-6 minutes, such that the total cycle length for all treatment points was about 30-45 minutes including about 18-20 minutes active treatment time.

The resulting paper or paperboard samples were evaluated for microorganism count using the Disintegration Method, which is believed to be equivalent to TAPPI Test Method T 449 om-90 titled "Bacterial Examination of Paper and Paperboard."

It will be noted that in Table 1, "Cont" refers to continuous treatment, "Cycle" refers to cyclic treatment, "AP" refers to addition point, "B1" refers to Busan 1078, "B2" refers to Busan 1215, "H" and "hypo" refer to hypochlorite, and "WW" refers to white water.

TABLE 1

| Trial | % PCW | Cont/ Cycle | AP 1 Busan 1078 lb/ton (B1) | B1 actives lb/ton | Busan 1215 lb/ton (B2) | Hypo lb/ton (H) | Ratio H/B2 | Total H + B2 actives lb/ton | H + B2 distribution to each addition point (AP), % of total dosage: Mixer 1 AP 2 | Mixer 1 AP 3 | Mixer 2 AP 4 | Mixer 2 AP 5 | Mixer 2 AP 6 | Mixer 2 AP 7 | Mixer 2 AP 8 | Mixer 2 AP 9 |
|---|---|---|---|---|---|---|---|---|---|---|---|---|---|---|---|---|
| A | 36 | Cont | 1.5 | 0.0225 | 6.30 | 15.7 | 4.1 | 2.44 | 33.0 | 33.0 | 10.0 | 8.0 | 8.0 | 6.0 | 2.0 | 0.0 |
| | 36 | Cycle | 1.5 | 0.0225 | 2.25 | 5.80 | 4.3 | 0.90 | 33.0 | 33.0 | 14.0 | 2.0 | 2.0 | 14.0 | 2.0 | 0.0 |
| B | 40 | Cont | 1.5 | 0.0225 | 8.80 | 23.7 | 4.4 | 3.63 | 33.0 | 33.0 | 9.0 | 8.0 | 8.0 | 5.0 | 2.0 | 2.0 |
| | 35 | Cont | 1.5 | 0.0225 | 7.70 | 20.7 | 4.5 | 3.17 | 33.0 | 33.0 | 9.0 | 8.0 | 8.0 | 5.0 | 2.0 | 2.0 |
| | <10 | Cont | 1.5 | 0.0225 | 5.85 | 15.8 | 4.4 | 2.42 | 22.0 | 23.0 | 15.0 | 12.0 | 12.0 | 12.0 | 2.0 | 2.0 |
| C | 35 | Cont | 1.5 | 0.0225 | 6.00 | 16.1 | 4.4 | 2.47 | 32.5 | 32.5 | 10.0 | 8.0 | 8.0 | 5.0 | 2.0 | 2.0 |
| D | 35 | Cont | 1.5 | 0.0225 | 8.35 | 22.1 | 4.4 | 3.40 | 36.0 | 36.0 | 8.0 | 7.0 | 7.0 | 4.0 | 2.0 | 0.0 |
| | <10 | Cont | 1.5 | 0.0225 | 5.80 | 17.0 | 4.8 | 2.57 | 30.0 | 30.0 | 10.0 | 10.0 | 10.0 | 8.0 | 2.0 | 0.0 |

| Trial | % PCW | Stock: Total H + B2 actives AP 2-5 lb/ton | Stock: Total H + B1 + B2 actives AP 1-5 lb/ton | WW: Total H + B2 actives AP 6-9 lb/ton | Ratio H + B2 actives stock/WW | Ratio total H + B1 + B2 actives stock/WW | Total H + B1 + B2 actives lb/ton |
|---|---|---|---|---|---|---|---|
| A | 36 | 2.05 | 2.07 | 0.4 | 5.3 | 5.3 | 2.46 |
| | 36 | 0.73 | 0.76 | 0.2 | 4.6 | 4.7 | 0.92 |
| B | 40 | 3.01 | 3.04 | 0.6 | 4.9 | 4.9 | 3.65 |
| | 35 | 2.63 | 2.66 | 0.5 | 4.9 | 4.9 | 3.19 |
| | <10 | 1.98 | 2.01 | 0.7 | 2.9 | 3.0 | 2.68 |
| C | 35 | 2.05 | 2.07 | 0.4 | 4.9 | 4.9 | 2.49 |
| D | 35 | 2.95 | 2.98 | 0.4 | 6.7 | 6.7 | 3.42 |
| | <10 | 2.05 | 2.07 | 0.5 | 4.0 | 4.0 | 2.59 |

Trial A

Trial A compares the effects of cyclic treatment with continuous treatment. Paper having a basis weight of about 52 lb/msf (52 lb/1000 sq. ft.) was formed from 100% recycled furnish (with a target of about 35% PCW and about 25% OCC). Biocide treatment was conducted using both cyclic and continuous treatment, as set forth in Table 1. The results are presented in Table 2. Additionally, the coliform level in each sample (typically measured for sanitary applications) was measured to be less than 10/g, which was the detection threshold.

TABLE 2

| Sample | Biocide addition method | Time | Microorganisms (cfu/g) | L* Value |
|---|---|---|---|---|
| A-1 | Continuous | 11:50 | 60,000 | 65.91 |
| A-2 | | 12:30 | 20,000 | 66.00 |
| A-3 | | 13:10 | 45,000 | 65.93 |
| A-4 | | 13:40 | 18,000 | 66.05 |
| A-5 | | 14:18 | 13,000 | 66.07 |
| A-6 | | 14:55 | 29,000 | 65.62 |
| A-7 | | 15:30 | 70,000 | 65.15 |
| A-8 | | 16:05 | 59,000 | 64.99 |
| A-9 | | 17:00 | 51,000 | 65.89 |
| A-10 | | 17:30 | 20,000 | 66.17 |
| A-11 | | 18:00 | 13,000 | 67.47 |
| A-12 | | 18:19 | 10,000 | 69.83 |
| A-13 | | 18:38 | 9,700 | NT |
| A-14 | Cyclic | 19:10 | 16,000 | 71.34 |
| A-15 | | 19:45 | 20,000 | 71.84 |
| A-16 | | 20:20 | 50,000 | 71.41 |
| A-17 | | 20:55 | 71,000 | 70.04 |
| A-18 | | 21:30 | 130,000 | 69.40 |
| A-19 | | 21:52 | 150,000 | 67.94 |
| A-20 | | 22:15 | 190,000 | NT |

Figure 2:
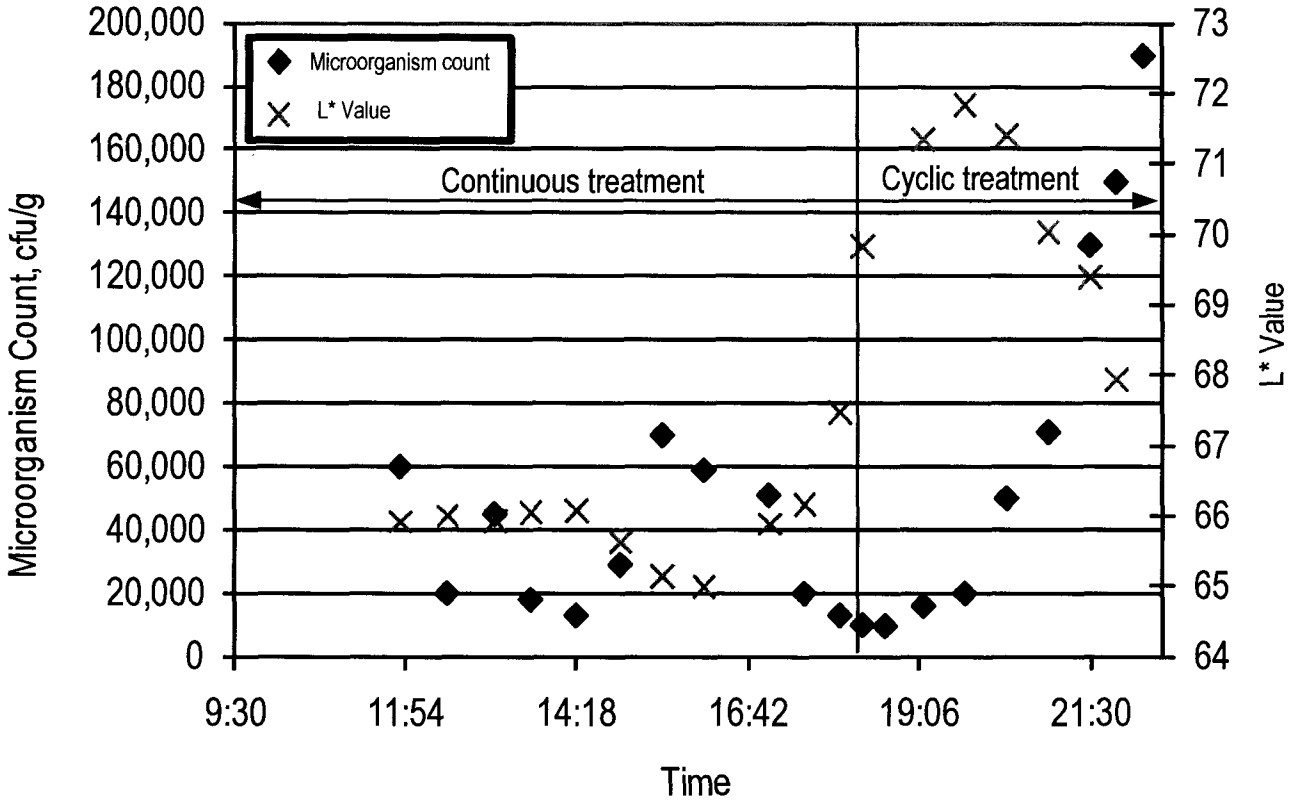
FIG. 2 compares microorganism count and "L*" value data for a cyclic treatment process and a continuous treatment process.

Notably, even though the samples made using cyclic treatment sample were made after the samples made using continuous treatment (and therefore had the benefit of a lower initial microbial level from the continuous addition portion of the trial), the samples made using cyclic addition were unable to attain the desired microorganism level. Further, it will be noted that the furnish used during the cyclic addition period contained more bleached fibers, as indicated by L* values (discussed below), and thus theoretically should have been easier to treat than the furnish used during the continuous period. Nonetheless, a two sample T-test (i.e., statistical analysis) of the results demonstrated that the samples prepared using continuous treatment exhibited a substantially lower microorganism count than those formed using cyclic treatment (Table 3 and FIG. 2). This data shows the unexpected result that continuous treatment reduces microorganisms by over 67% on the average compared to cyclic treatment.

It will also be noted the samples formed using continuous treatment exceeded the maximum microorganism limit due to the presence of excess levels of OCC in the furnish (actual PCW levels were from about 36 to about 46%, with OCC levels exceeding 25%). While not wishing to be bound by theory, this is likely because of the demand that the excess amount of OCC placed on the monochloramine in the system.

TABLE 3

| | No. of samples | Mean | Standard deviation | Standard error |
|---|---|---|---|---|
| Microorganisms (cfu/g) - continuous treatment | 13 | 32131 | 21762 | 6036 |
| Microorganisms (cfu/g) - cyclic treatment | 7 | 89571 | 67744 | 25605 |
| Difference in mean | | −57441 | | |
| 90% Confidence for difference | | −108559, −6322 | | |
| T-Test of difference | | 0 (vs not =) | | |
| T-Value | | −2.18 | | |
| P-Value | | 0.072 | | |
| Degrees of freedom | | 6 | | |

It will be appreciated that due to the variable nature of recycled materials, it may not be possible to obtain a particular desired furnish composition with precision. Instead, the resulting paper typically is examined using fiber species analysis, in which the number of bleached and unbleached fibers are counted under a microscope to determine if the paper has the desired content.

However, the present inventors have developed a means of estimating the unbleached fiber content of the paperboard (and where there is no unbleached PIW, the OCC and/or news content, where present) during the manufacturing process. First, a colorimeter (e.g., a Konica Minolta Chroma Meter model CR-410 colorimeter (Konica Minolta, Ramsey, N.J.)) may be used to measure the color of various paper samples. The colorimeter generates an "L* value," which represents one of the three color coordinates on the CIELAB color scale, with L*=0 indicating black and L*=100 indicating white. Thus, lower L* values generally indicate a greater presence of unbleached fibers (which are typically darker in color), while higher L* values generally indicate a greater presence of bleached fibers (which are typically lighter in color). Next, a range of acceptable L* values is determined using paperboard that is known to have a particular unbleached fiber content as determined using traditional fiber species analysis. As the paper is manufactured, the L* value of paper samples may be compared with the target L* values to determine whether the L* value is within the desired range. If the L* value is within the desired range, the paper likely has about the same composition as the target paper samples. If not, adjustments may be made to the incoming materials to achieve the desired composition. For example, if the L* value is too low, the OCC content may be lowered and the content of other PCW, such as sorted office waste, may be raised to keep the same total % PCW.

It will be noted that dyes and other pigments from PCW components of most existing commercial PCW grades do not contribute significantly to the L* values. However, if a heavily coated or heavily printed PCW grade is used as a major component of the furnish, a different calibration curve may be needed to establish the relationship of L* and % unbleached fibers.

L* values were measured for various samples during Trial A to approximate the fiber content of the paper and to acquire additional L* value data. The results are presented in Table 2 and FIG. 2. The L* values observed for the samples made with cyclic treatment were higher, indicating a greater content of bleached fiber in the furnish, which theoretically should be easier to treat than the furnish used during the continuous treatment phase. Despite this disadvantage, the samples made using continuous treatment significantly outperformed the samples made using cyclic treatment.

Trials B, C, and D

Trials B, C, and D demonstrate the ability to use continuous treatment to attain a microorganism count of less than 5000 cfu/g for various LMDFC applications (e.g., for cupstock to make beverage cups) using a variety of materials. In each trial, 100% recycled materials were used to form the paperboard, with various levels and types of PCW. For some samples, the microorganism level was measured by two different test laboratories, as denoted by cfu/g (1) and cfu/g (2). Samples that were not evaluated by the second laboratory are denoted with "NT" (not tested).

Notably, the samples including up to about 35% PCW fibers exhibited a microorganism level of less than 5,000 cfu/g. Likewise, the samples including up to about 25% OCC achieved a microorganism level of less than 5,000 cfu/g. Further, the samples including 100% recycled board (where the exact contents were unknown) achieved a microorganism level of less than 5,000 cfu/g. Thus, continuous treatment can be used to make paperboard for LMDFC from a variety of materials.

It will be noted that there was some variability in results for the samples with about 40% OCC fibers. Thus, it will be appreciated that some refining of the process variables may be needed to achieve the desired microorganism level on a consistent basis.

The coliform in each sample from Trials B, C, and D was measured to be less than 10/g.

Additionally, the samples from Trial C were evaluated using the Swab test (SMDP17 13.045). The test was run on a composite of six samples including samples C-1 through C-5. The microorganism level was 0.370 cfu/sq. inch.

TABLE 3

| Sample | Recycled waste materials (100% recycled) | Grade | Micro-organisms cfu/g (1) | Micro-organisms cfu/g (2) |
|---|---|---|---|---|
| B-1 | 35% PCW | 58 lb/msf | 390 | NT |
| B-2 | (25% OCC + 10% | Paperboard | 920 | NT |
| B-3 | SOP) | | 940 | NT |
| B-4 | | | 770 | NT |
| B-5 | | | 720 | NT |
| B-6 | 40% PCW | 52 lb/msf | 27000 | NT |
| B-7 | (all OCC) | Paperboard | 3500 | NT |
| B-8 | | | 990 | NT |
| B-9 | | | 1800 | NT |
| B-10 | | | 2200 | NT |
| B-11 | | | 9800 | NT |
| B-12 | | | 1800 | NT |

TABLE 3-continued

| Sample | Recycled waste materials (100% recycled) | Grade | Micro-organisms cfu/g (1) | Micro-organisms cfu/g (2) |
|---|---|---|---|---|
| B-13 | | | 900 | NT |
| B-14 | | | 940 | NT |
| B-15 | | | 15000 | NT |
| B-16 | | | 6000 | NT |
| B-17 | | | 2200 | NT |
| B-18 | % PCW unknown | 35 lb/msf | 30 | NT |
| B-19 | (0% OCC) | paperboard | 60 | NT |
| B-20 | | | 670 | NT |
| B-21 | | | 210 | NT |
| B-22 | | | 30 | NT |
| B-23 | | | 10 | NT |
| B-24 | | | 20 | NT |
| B-25 | | | 40 | NT |
| B-26 | | | 600 | NT |

TABLE 4

| Sample | Recycled waste materials (100% recycled) | Grade | Micro-organisms cfu/g (1) | Micro-organisms cfu/g (2) |
|---|---|---|---|---|
| C-1 | 35% PCW | 0.0128 inch thick | 960 | NT |
| C-2 | (25% OCC + | (12.8 pt) paperboard | 700 | NT |
| | 10% SOP) | (e.g., for cupstock) | | |
| C-3 | | 0.0174 inch thick | 580 | NT |
| C-4 | | (17.4 pt) paperboard | 740 | NT |
| C-5 | | (e.g., for cupstock) | 670 | NT |

TABLE 5

| Sample | Recycled waste materials (100% recycled) | Grade | Micro-organisms cfu/g (1) | Micro-organisms cfu/g (2) |
|---|---|---|---|---|
| D-1 | 35% PCW | 0.0174 inch thick | 670 | 980 |
| D-2 | (25% OCC + | (17.4 pt) paperboard | 1000 | 570 |
| D-3 | 10% SOP) | (e.g., for cupstock) | 1400 | 2280 |
| D-4 | % PCW unknown | 34 lb/msf | 790 | NT |
| | (0% OCC) | paperboard | | |
| D-5 | % PCW unknown | 35 lb/msf | 2,900 | NT |
| D-6 | (0% OCC) | paperboard | 1,000 | NT |
| D-7 | | | 480 | NT |
| D-8 | % PCW unknown | 36 lb/msf | 340 | NT |
| D-9 | (0% OCC) | paperboard | 330 | NT |
| D-10 | % PCW unknown | 38 lb/msf | 230 | NT |
| D-11 | (0% OCC) | paperboard | 3,000 | NT |
| D-12 | | | 990 | NT |
| D-13 | % PCW unknown | 50 lb/msf | 320 | NT |
| D-14 | (0% OCC) | paperboard | 50 | NT |
| D-15 | | | 10 | NT |
| D-16 | | | 60 | NT |
| D-17 | | | 200 | NT |

It will be readily understood by those persons skilled in the art that the present invention is susceptible of broad utility and application. It will also be recognized by those skilled in the art that various elements discussed with reference to the various embodiments may be interchanged to create entirely new embodiments coming within the scope of the present invention. While the present invention is described herein in detail in relation to specific embodiments, it is to be understood that this detailed description is only illustrative and exemplary of the present invention and is made merely for purposes of providing a full and enabling disclosure of the present invention and to set forth the best mode of practicing the invention known to the inventors at the time the invention was made. Many adaptations of the present invention other than those herein described, as well as many variations, modifications, and equivalent arrangements will be apparent from or reasonably suggested by the present invention and the above detailed description without departing from the substance or scope of the present invention. Accordingly, the detailed description set forth herein is not intended nor is to be construed to limit the present invention or otherwise to exclude any such other embodiments, adaptations, variations, modifications, and equivalent arrangements of the present invention.

What is claimed is:

1. A method of making a paper-based product, the method comprising:

substantially continuously treating a papermaking furnish with a biocide, wherein the furnish comprises from greater than 0% to 100% recycled fibers, and wherein the furnish has a microorganism level of greater than 5,000 colony forming units per gram; and forming the furnish into the paper-based product, wherein the paper-based product comprises at least one of a sizing chemical and a strength additive, wherein substantially continuously treating the furnish with the biocide reduces the microorganism level so that the paper-based product has a microorganism level of less than 5,000 colony forming units per gram.

2. The method of claim 1, wherein the paper-based product comprises from greater than 0% to about 40% unbleached fibers.

3. The method of claim 1, wherein the biocide comprises an oxidizing biocide.

4. The method of claim 3, wherein the biocide comprises a haloamine.

5. The method of claim 4, wherein the biocide comprises monochloramine.

6. The method of claim 4, wherein the furnish is substantially continuously treated with from about 0.1 lb to about 10 lb haloamine per ton of furnish on active ingredient basis.

7. The method of claim 4, wherein the furnish is substantially continuously treated with from about 2 to about 4 lb haloamine per ton of furnish.

8. The method of claim 1, wherein the biocide is a first biocide, and the method further comprises substantially continuously treating the furnish with a second biocide.

9. The method of claim 8, wherein the second biocide comprises a non-oxidizing biocide.

10. The method of claim 9, wherein the second biocide comprises isothiazolin.

11. The method of claim 10, wherein the furnish is substantially continuously treated with from about 0.01 to about 3 lb of the second biocide per ton of furnish on an active ingredient basis.

12. The method of claim 10, wherein the furnish is substantially continuously treated with from about 0.015 to about 0.04 lb of the second biocide per ton of furnish on an active ingredient basis.

13. The method of claim 1, wherein the furnish is substantially continuously treated with the biocide on a paper machine including a plurality of vessels, wherein the furnish is substantially continuously treated with the biocide in each vessel of the plurality of vessels having a retention time for the furnish of at least about 3 minutes.

14. The method of claim 1, wherein the furnish is substantially continuously treated with the biocide on a paper machine including a plurality of vessels, wherein the furnish is substantially continuously treated with the biocide in each vessel of the plurality of vessels having a retention time for the furnish of at least about 4 minutes.

15. The method of claim 1, wherein the furnish is substantially continuously treated with the biocide on a paper machine including a plurality of vessels, wherein the furnish is substantially continuously treated with the biocide in each vessel of the plurality of vessels having a retention time for the furnish of at least about 5 minutes.

16. The method of claim 1, wherein the paper-based product comprises paper, paperboard, or an article formed from paper or paperboard.

17. The method of claim 16, wherein the article comprises a cup, a plate, a bowl, a tray, a platter, a container, a food package, or any combination thereof.

18. The method of claim 1, wherein the at least one of the sizing chemical and the strength additive is treated with the biocide.

19. The method of claim 1, wherein the sizing chemical is selected from the group consisting of alkyl ketene dimer, alkyl succinic anhydride, and rosin.

20. The method of claim 1, wherein the strength additive is selected from the group consisting of starch, carboxyl methylcellulose, and polyvinyl alcohol.

21. A method of making a paper-based product, the method comprising:

substantially continuously adding a biocide to a stock stream on a paper machine, wherein the stock stream includes from greater than 0% to 100% recycled fibers, the recycled fibers having a microorganism level of greater than 5,000 colony forming units per gram, and forming the paper-based product from the recycled fibers, wherein the paper-based product comprises at least one of a sizing chemical and a strength additive, wherein substantially continuously adding the biocide to the stock stream reduces the microorganism level of the recycled fibers so that the paperboard formed from the recycled fibers has a microorganism count of less than 5,000 colony forming units per gram.

22. The method of claim 21, wherein the paper-based product comprises from greater than 0% to about 40% unbleached fibers.

23. The method of claim 21, further comprising substantially continuously adding the biocide to at least one water stream of the paper machine.

24. The method of claim 23, wherein the at least one water stream comprises a white water stream and a fresh water stream.

25. The method of claim 24, wherein the biocide is added to the white water stream and the fresh water stream.

26. The method of claim 23, wherein substantially continuously adding the biocide to the stock stream and the at least one water stream comprises adding the biocide in at least two locations along the stock stream and at least two locations along the at least one water stream.

27. The method of claim 23, wherein substantially continuously adding the biocide to the stock stream and the at least one water stream comprises adding the biocide in at least three locations along the stock stream and at least three locations along the at least one water stream.

28. The method of claim 23, wherein substantially continuously adding the biocide to the stock stream and the at least one water stream comprises adding the biocide in at least four locations along the stock stream and at least four locations along the at least one water stream.

29. The method of claim 23, wherein substantially continuously adding the biocide to the stock stream and the at least one water stream comprises adding from about 0.1 lb to about 10 lb biocide per ton of furnish on an active ingredient basis.

30. The method of claim 23, wherein substantially continuously adding the biocide to the stock stream and the at least one water stream comprises adding from about 2 to about 4 lb biocide per ton of furnish on an active ingredient basis.

31. The method of claim 23, wherein the biocide is a first biocide, the paper machine further comprises a pulper, and the method further comprises substantially continuously adding a second biocide to the pulper.

32. The method of claim 31, wherein the first biocide comprises an oxidizing biocide, and the second biocide comprises a non-oxidizing biocide.

33. The method of claim 32, wherein the first biocide comprises a haloamine.

34. The method of claim 32, wherein the first biocide comprises monochloramine, and the second biocide comprises isothiazolin.

35. The method of claim 21, wherein the at least one of the sizing chemical and the strength additive is treated with the biocide.

36. The method of claim 21, wherein the paper-based product comprises paper, paperboard, or an article formed from paper or paperboard.

37. The method of claim 36, wherein the article comprises a cup, a plate, a bowl, a tray, a platter, a container, a food package, or any combination thereof.

38. The method of claim 21, wherein the sizing chemical comprises alkyl ketene dimer, alkyl succinic anhydride, or rosin.

39. The method of claim 21, wherein the strength additive comprises starch, carboxyl methylcellulose, or polyvinyl alcohol.

40. A method of making a paper-based product, the method comprising:

substantially continuously treating a papermaking furnish with a biocide, wherein the furnish comprises from greater than 0% to 100% recycled fibers, and wherein the furnish has a microorganism level of greater than 5,000 colony forming units per gram;

adding at least one of a sizing chemical and a strength additive to the furnish; and forming the furnish into the paper-based product, wherein the paper-based product comprises the at least one of the sizing chemical and the strength additive, wherein substantially continuously treating the furnish with the biocide reduces the microorganism level so that the paper-based product has a microorganism level of less than 5,000 colony forming units per gram.

41. The method of claim 40, wherein the at least one of the sizing chemical and the strength additive is treated with the biocide.

42. The method of claim 40, wherein the sizing chemical is selected from the group consisting of alkyl ketene dimer, alkyl succinic anhydride, and rosin.

43. The method of claim 40, wherein the strength additive is selected from the group consisting of starch, carboxyl methylcellulose, and polyvinyl alcohol.

44. The method of claim 40, wherein the paper-based product comprises from greater than 0% to about 40% unbleached fibers.

45. The method of claim 40, wherein the biocide comprises an oxidizing biocide.

46. The method of claim 45, wherein the biocide comprises a haloamine.

47. The method of claim 46, wherein the biocide comprises monochloramine.

48. The method of claim 40, wherein
the biocide is a first biocide, and
the method further comprises substantially continuously treating the furnish with a second biocide.

49. The method of claim 48, wherein the second biocide comprises a non-oxidizing biocide.

50. The method of claim 49, wherein the second biocide comprises isothiazolin.

51. The method of claim 40, wherein the paper-based product comprises paper, paperboard, or an article formed from paper or paperboard.

52. The method of claim 51, wherein the article comprises a cup, a plate, a bowl, a tray, a platter, a container, or a food package.

53. A method of making a paper-based product, the method comprising:
substantially continuously adding a biocide to a stock stream of a paper machine, wherein the stock stream includes from greater than 0% to 100% recycled fibers, the recycled fibers having a microorganism level of greater than 5,000 colony forming units per grain;
adding at least one of a sizing chemical and a strength additive to the stock stream; and
forming the paper-based product from the recycled fibers, wherein the paper-based product comprises the at least one of the sizing chemical and the strength additive,
wherein substantially continuously adding the biocide to the stock stream reduces the microorganism level of the recycled fibers so that the paperboard formed from the recycled fibers has a microorganism count of less than 5,000 colony forming units per gram.

54. The method of claim 53, wherein the at least one of the sizing chemical and the strength additive is treated with the biocide.

55. The method of claim 53, wherein the sizing chemical is selected from the group consisting of alkyl ketene dimer, alkyl succinic anhydride, and rosin.

56. The method of claim 53, wherein the strength additive is selected from the group consisting of starch, carboxyl methylcellulose, and polyvinyl alcohol.

57. The method of claim 53, wherein the paper-based product comprises from greater than 0% to about 40% unbleached fibers.

58. The method of claim 53, further comprising substantially continuously adding the biocide to at least one water stream of the paper machine.

59. The method of claim 58, wherein the at least one water stream comprises a white water stream and a fresh water stream.

60. The method of claim 53, wherein
the biocide is a first biocide, and
the method further comprises substantially continuously adding a second biocide to a pulper of the paper machine.

61. The method of claim 60, wherein
the first biocide comprises an oxidizing biocide, and
the second biocide comprises a non-oxidizing biocide.

62. The method of claim 61, wherein the first biocide comprises a haloamine.

63. The method of claim 61, wherein
the first biocide comprises monochloramine, and
the second biocide comprises isothiazolin.

64. The method of claim 53, wherein the paper-based product comprises paper, paperboard, or an article formed from paper or paperboard.

65. The method of claim 64, wherein the article comprises a cup, a plate, a bowl, a tray, a platter, a container, or a food package.

66. A method of making a paper-based product, the method comprising:
substantially continuously treating a papermaking furnish with a biocide, the furnish comprising from greater than 0% to 100% recycled fibers, wherein the furnish has a microorganism level of greater than 5,000 colony forming units per gram;
forming the furnish into the paper-based product; and
treating the paper-based product with at least one of a sizing chemical and a strength additive, so that the paper-based product comprises the at least one of the sizing chemical and the strength additive,
wherein substantially continuously treating the furnish with the biocide reduces the microorganism level so that the paper-based product has a microorganism level of less than 5,000 colony forming units per gram.

67. The method of claim 66, wherein the at least one of the sizing chemical and the strength additive is treated with the biocide.

68. The method of claim 66, wherein the sizing chemical is selected from the group consisting of alkyl ketene dimer, alkyl succinic anhydride, and rosin.

69. The method of claim 66, wherein the strength additive is selected from the group consisting of starch, carboxyl methylcellulose, and polyvinyl alcohol.

70. The method of claim 66, wherein the paper-based product comprises from greater than 0% to about 40% unbleached fibers.

71. The method of claim 66, wherein the biocide comprises an oxidizing biocide.

72. The method of claim 71, wherein the biocide comprises a haloamine.

73. The method of claim 72, wherein the biocide comprises monochloramine.

74. The method of claim 66, wherein
the biocide is a first biocide, and
the method further comprises substantially continuously treating the furnish with a second biocide.

75. The method of claim 74, wherein the second biocide comprises a non-oxidizing biocide.

76. The method of claim 75, wherein the second biocide comprises isothiazolin.

77. The method of claim 66, wherein the paper-based product comprises paper, paperboard, or an article formed from paper or paperboard.

78. The method of claim 77, wherein the article comprises a cup, a plate, a bowl, a tray, a platter, a container, or a food package.

* * * * *